US008961046B2

(12) United States Patent
Eoka

(10) Patent No.: US 8,961,046 B2
(45) Date of Patent: Feb. 24, 2015

(54) PAPER DISCHARGE DEVICE AND IMAGE FORMING APPARATUS HAVING THE SAME

(75) Inventor: Kenji Eoka, Suntoh-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 396 days.

(21) Appl. No.: 12/860,381

(22) Filed: Aug. 20, 2010

(65) Prior Publication Data

US 2011/0057013 A1 Mar. 10, 2011

(30) Foreign Application Priority Data

Sep. 8, 2009 (JP) ..... 2009-207444

(51) Int. Cl.

| | |
|---|---|
| ***B41J 13/00*** | (2006.01) |
| ***B65H 18/14*** | (2006.01) |
| ***B65H 20/40*** | (2006.01) |
| ***B41J 13/10*** | (2006.01) |
| ***B41J 15/04*** | (2006.01) |
| ***B65H 29/00*** | (2006.01) |
| *B41J 11/00* | (2006.01) |

(52) U.S. Cl.

CPC ..... *B65H 20/40* (2013.01); *B41J 13/106* (2013.01); *B41J 15/042* (2013.01); *B65H 29/008* (2013.01); *B41J 11/0095* (2013.01); *B65H 2402/43* (2013.01); *B65H 2402/443* (2013.01); *B65H 2408/13* (2013.01)

USPC ..... 400/642; 400/611; 242/535.1

(58) Field of Classification Search

CPC ..... B65H 39/045; B65H 2301/3422; B65H 2405/34; B65H 2407/33; B65H 2407/32; B65H 2408/13; B65H 2408/211; B65H 2511/511; B65H 2513/50; B65H 2513/511; B65H 2551/12; B65H 29/008; B65H 2701/11332; B65H 2701/1133; B65H 2701/10; B65H 2405/4414; B65H 2301/4193

USPC ..... 400/642, 578, 583, 611, 613; 399/384, 399/405; 271/175, 178; 242/535.1, 615.2

See application file for complete search history.

(56) References Cited

U.S. PATENT DOCUMENTS

| | | | | |
|---|---|---|---|---|
| 4,838,497 | A * | 6/1989 | Kramer et al. | 242/535.1 |
| 5,060,880 | A * | 10/1991 | Mayer | 242/419.5 |
| 5,879,090 | A * | 3/1999 | Hoyt et al. | 400/578 |
| 6,019,209 | A * | 2/2000 | Hara et al. | 194/206 |
| 6,428,226 | B1 | 8/2002 | Suzuki et al. | |

(Continued)

FOREIGN PATENT DOCUMENTS

| | | |
|---|---|---|
| JP | 4128374 | 4/1992 |
| JP | 07-220139 | 8/1995 |

(Continued)

*Primary Examiner* — Matthew G Marini

(74) *Attorney, Agent, or Firm* — Amin, Turocy & Watson, LLP

(57) ABSTRACT

A paper discharge device and an image forming apparatus include a holding unit 101 which is rotatably mounted to a frame and is configured to hold a recording medium P discharged from an image forming unit 110 in a rolled state. The paper discharge device 100 performs a holding operation before a discharge operation. When the recording medium P is discharged, the paper discharge device 100 allows the holding unit 101 to be rotated to reach the discharge position so that the recording medium P is discharged. When the recording medium P is collected, the paper discharge device 100 allows the recording medium P to be held again within the holding unit 101, and then allows the holding unit 101 to be rotated to reach the collecting position.

13 Claims, 11 Drawing Sheets

(56) References Cited

U.S. PATENT DOCUMENTS

| | | | | |
|---|---|---|---|---|
| 6,674,035 | B2 | 1/2004 | Ito | |
| 6,776,410 | B2 * | 8/2004 | Fukuda | 271/207 |
| 7,641,190 | B2 * | 1/2010 | Hara et al. | 271/145 |
| 8,297,865 | B2 * | 10/2012 | McGarry | 400/642 |
| 2007/0158902 | A1 * | 7/2007 | Kohira | 271/225 |

FOREIGN PATENT DOCUMENTS

| | | |
|---|---|---|
| JP | 11-123850 | 5/1999 |
| JP | 2001-261228 | 9/2001 |
| JP | 2002-216080 | 8/2002 |
| JP | 2003-182918 | 7/2003 |

* cited by examiner

PAPER DISCHARGE DEVICE AND IMAGE FORMING APPARATUS HAVING THE SAME

CROSS-REFERENCE TO RELATED APPLICATIONS

This application is based upon and claims the benefit of priority from Japanese Patent Application No. 2009-207444, filed on Sep. 8, 2009, the entire content of which is incorporated herein by reference.

FIELD

Embodiments described herein relate generally to a paper discharge device that temporarily holds a recording medium discharged from an image forming apparatus, and discharges or collects the discharged recording medium, and an image forming apparatus including a paper discharge device.

BACKGROUND

An image forming apparatus such as a printer mounted in an information processing device such as an ATM (automated teller machine) terminal device in some instance will need the capability to output a paper copy of the image to a user. A printer serves to print part of the information processed by an information processing device on a recording medium such as roll paper, and then discharge the recording medium after cutting it for delivery to a customer.

In this case, however, there may be a problem in that a paper jam occurs when the customer forcibly pulls a part of the recording medium discharged from the printer during the printing of the recording medium.

DETAILED DESCRIPTION

According to one embodiment, a paper discharge device includes a holding unit mounted rotatably to a frame. The holding unit includes a recording medium receiving inlet configured to receive a recording medium having an image formed thereon, a recording medium feeding path through which the received recording medium is conveyed, and a cylindrical housing configured to hold the conveyed recording medium in a rolled state. The paper discharge device further includes a driven pinch roller and a driving pinch roller mounted at the recording medium receiving inlet, and a first sensor disposed at a side of the recording medium receiving inlet and a second sensor disposed at a side of the cylindrical housing with the driving pinch roller interposed between the first sensor and the second sensor. The holding unit rotates to reach a holding position where the recording medium having an image formed thereon is received, and the driven pinch roller and the driving pinch roller are turned until the first sensor detects a rear end of a paper to cause the recording medium to be held in a rolled state within the cylindrical housing. Further, the holding unit rotates to reach a discharge position where the recording medium is discharged, and the driven pinch roller and the driving pinch roller are rotated in a reverse direction until the second sensor detects a rear end of the paper to cause the recording medium to be discharged.

A paper discharge device and an image forming apparatus including the paper discharge device according to one embodiment will be hereinafter described in detail with reference to the accompanying drawings.

Figure 1:
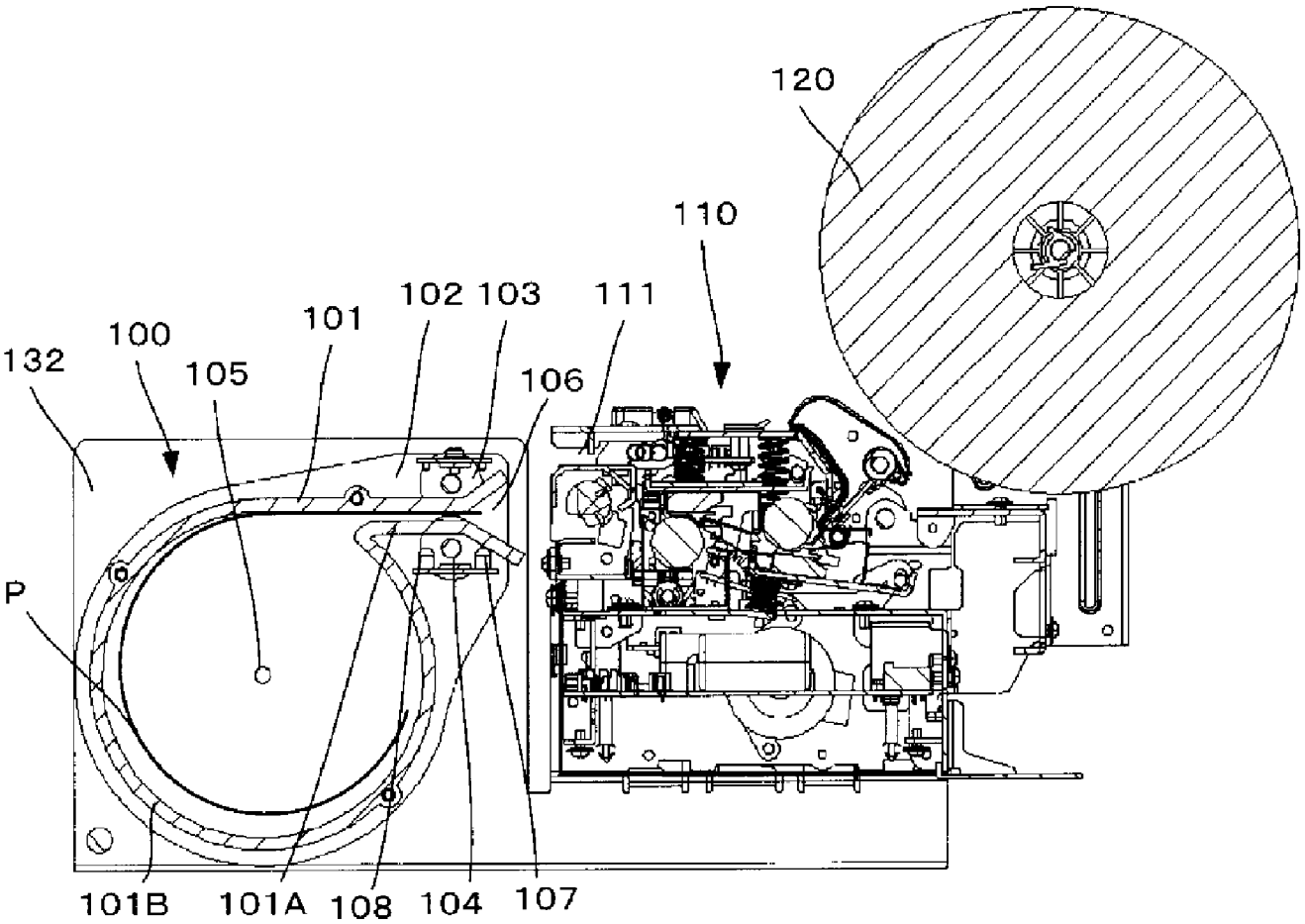
FIG. 1 is a side cross-sectional view of a paper discharge device and an image forming apparatus including the paper discharge device according to an exemplary embodiment in a state where the holding operation of a recording medium is terminated.
Figure 2:
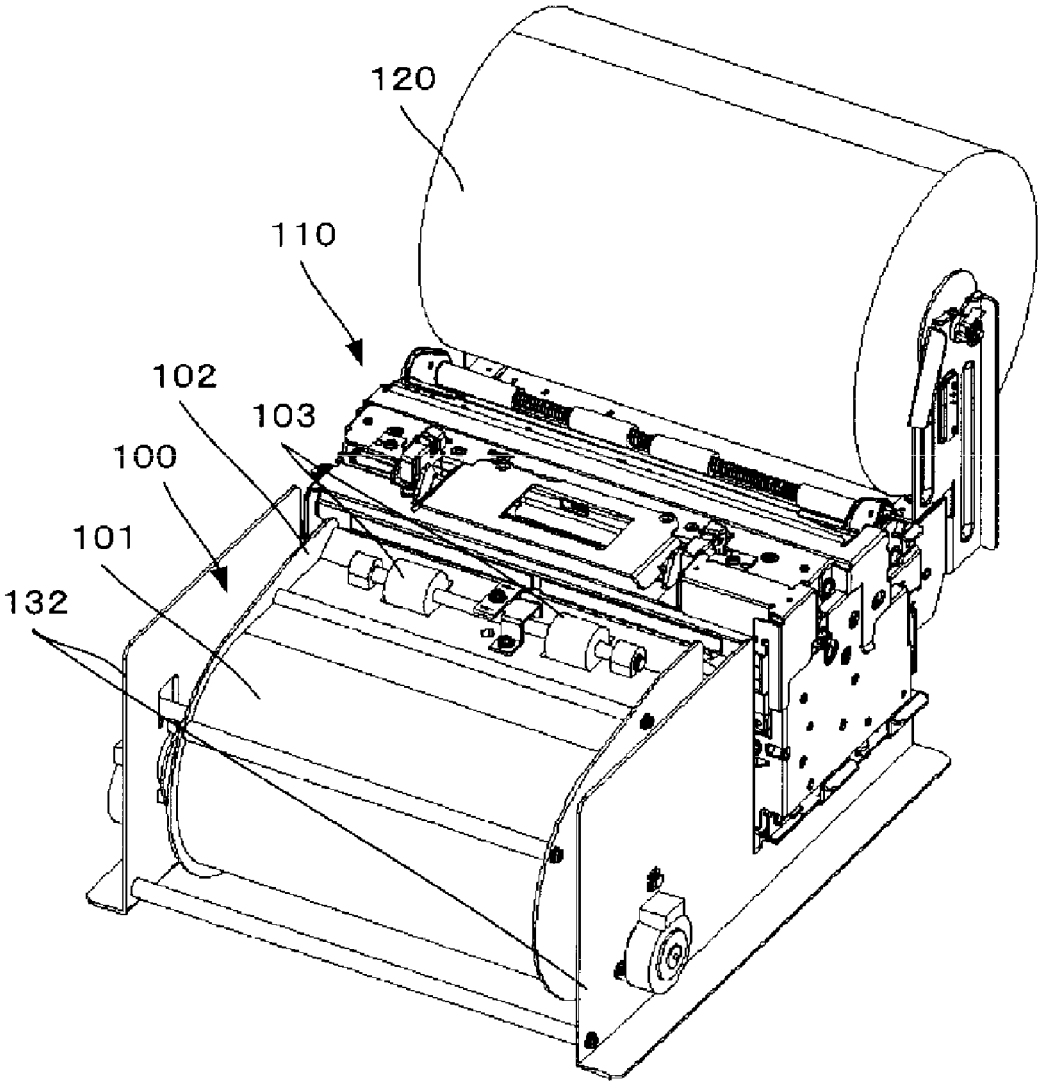
FIG. 2 is a perspective view of a paper discharge device and an image forming apparatus including the paper discharge device according to an exemplary embodiment.

FIG. 1 is a side cross-sectional view of a paper discharge device 100 and an image forming apparatus including the paper discharge device 100 in a state where the holding operation of a recording medium is terminated. Also, FIG. 2 is a perspective view of a paper discharge device 100 and an image forming apparatus including the paper discharge device 100. As shown in FIGS. 1 and 2, the image forming apparatus includes a paper discharge device 100 and an image forming unit 110.

The image forming unit 110 includes a conveying mechanism configured to convey a recording medium such as roll paper 120 and a printing mechanism configured to perform a printing operation on the recording medium conveyed by the conveying mechanism. The printing mechanism employs, for example, a thermal head, which applies heat to a thermal paper, i.e., the conveyed recording medium to form an image on the recording medium, and a carriage that reciprocatingly moves the thermal head. The recording medium having the image formed thereon is discharged through the paper discharge opening 111 and is guided to the paper discharge device 100.

The paper discharge device 100 includes a holding unit 101 that is configured to hold the conveyed recording medium in a rolled state therein, a pair of retention units 102 configured such that the holding unit 101 is interposed between both sides thereof The paper discharge device 100 further includes a driven pinch roller 103 disposed at a recording medium receiving inlet 106 of the holding unit 101, and a driving pinch roller 104 disposed opposite the driven pinch roller 103 and configured to be turned to cause the driven pinch roller 103 to be turned together with the driving pinch roller 104. Further, the paper discharge device 100 includes a first sensor 107 mounted nearer to a recording medium receiving inlet 106 than a nip portion formed between the driven pinch roller 103 and the driving pinch roller 104, and a second sensor 108 mounted nearer to an opposite side of the recording medium receiving inlet 106 than the nip portion formed between the driven pinch roller 103 and the driving pinch roller 104. The paper discharge device 100 is rotatably mounted to a frame 132 by means of a turning shaft 105.

The recording medium receiving inlet 106 of the holding unit 101 may be opened toward the image forming unit 110, and is formed to be gradually narrowed toward the direction of the driven pinch roller 103 and the driving pinch roller 104.

The holding unit 101 has a recording medium feeding path 101A extending from the recording medium receiving inlet 106 in a direction opposite the direction of the image forming unit 110 via the nip portion formed between the driven pinch roller 103 and the driving pinch roller 104.

The holding unit 101 includes a cylindrical housing 101B formed in a circular arc shape so that it rotates along a turning shaft 105 in a direction opposite the direction of the recording medium receiving inlet 106 from the recording medium feeding path 101A.

That is, the recording medium feeding path 101A of the holding unit 101 is formed along a tangential line of the cylindrical housing 101B extending toward the direction of the image forming unit 110. The recording medium feeding path 101A is formed at one end with the recording medium receiving inlet 106 opened toward the image forming unit 110, and the driven pinch roller 103 and the driving pinch roller 104 are mounted in the vicinity of the recording medium receiving inlet 106. The holding unit 101 includes the first sensor 107 disposed at a side of the recording medium receiving inlet 106 and the second sensor 108 disposed at a side of the cylindrical housing 101B with the driving pinch roller 104 interposed between the first sensor 107 and the second sensor 108.

A recording medium P having an image formed thereon is fed to the nip portion between the driven pinch roller 103 and the driving pinch roller 104 via the recording medium receiving inlet 106 from the image forming unit 110. The driven pinch roller 103 and the driving pinch roller 104 is rotated with the recording medium P inserted into the nip portion therebetween to cause the recording medium P to be conveyed along the recording medium feeding path 101A. When a front end of the recording medium P reaches the cylindrical housing 101B, the recording medium P is rolled along the cylindrical housing 101B and is held within the cylindrical housing 101B.

The first sensor 107 and the second sensor 108 may employ an optical sensor. When the optical path is blocked by the recording medium P, the optical sensor enters an ON state. On the other hand, when the optical path is not blocked, the optical sensor enters an OFF state.

Figure 3:
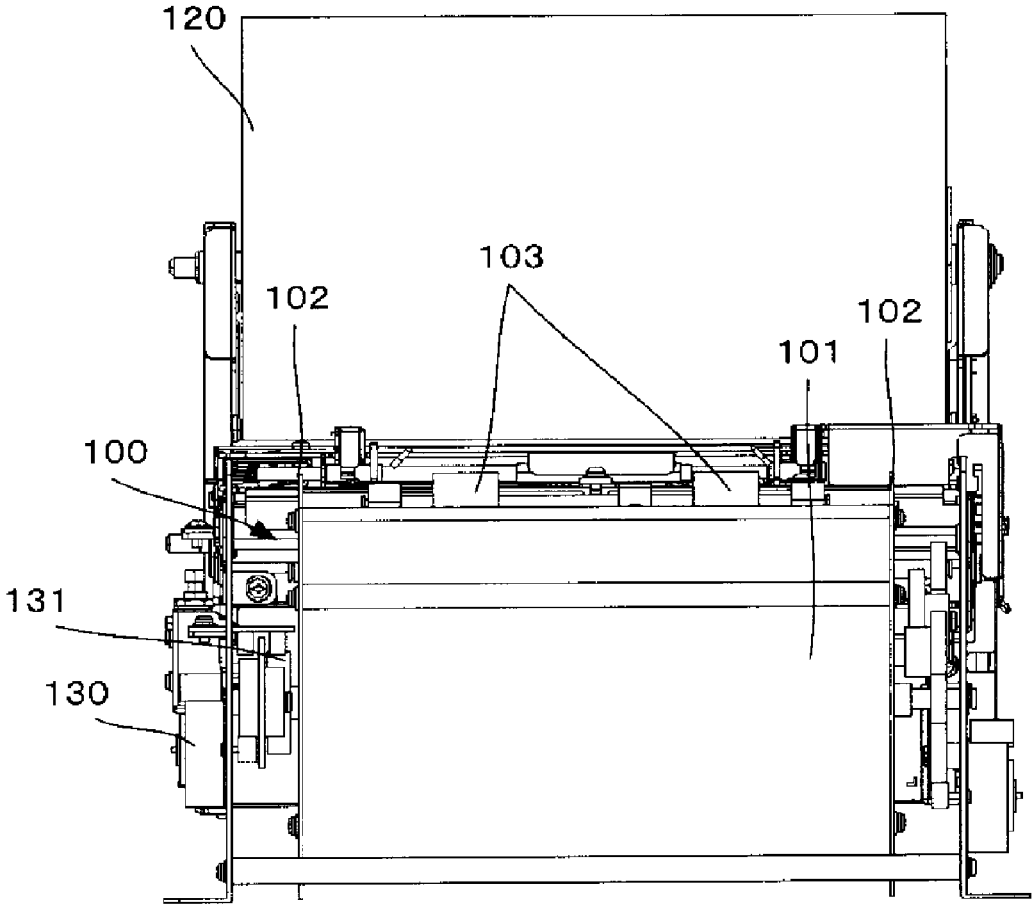
FIG. 3 is a front view of a paper discharge device and an image forming apparatus including the paper discharge device according to an exemplary embodiment.
Figure 4:
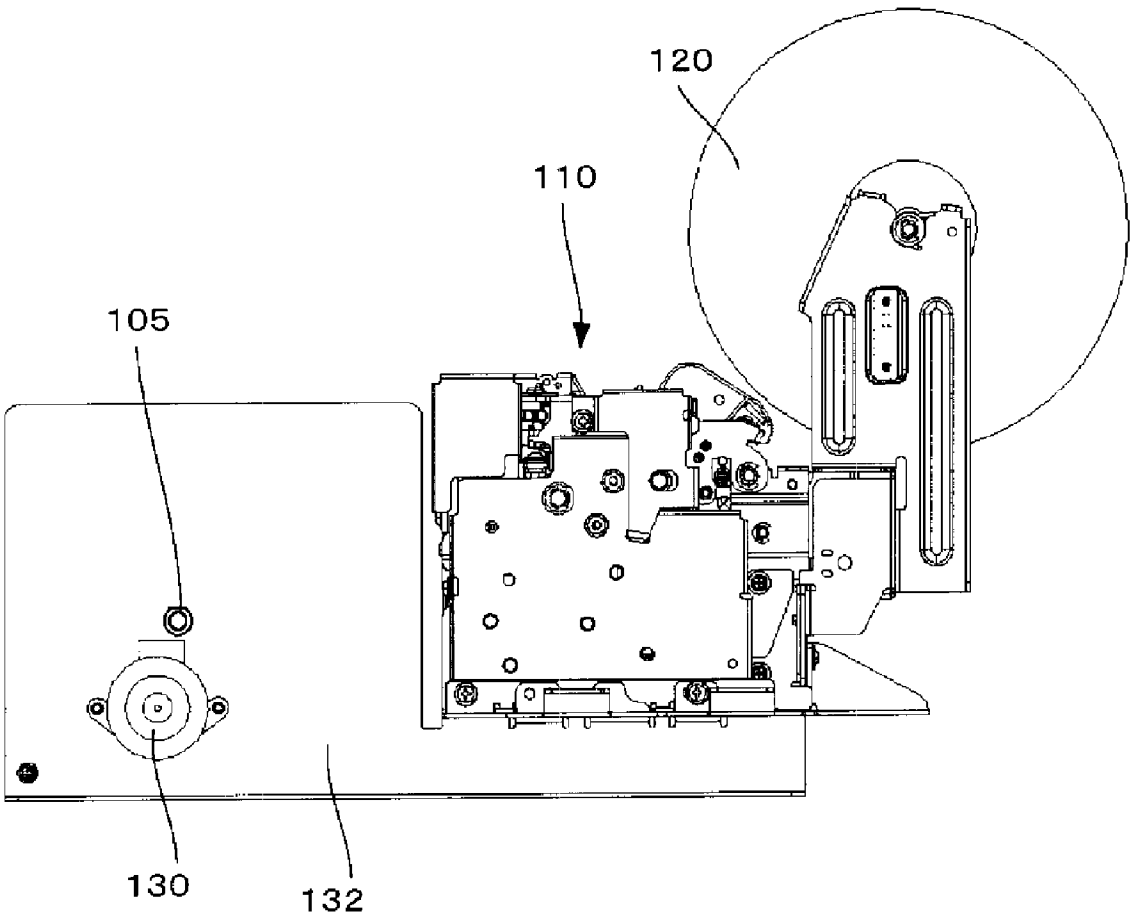
FIG. 4 is a right side view of a paper discharge device and an image forming apparatus including the paper discharge device according to an exemplary embodiment.

FIG. 3 is a front view of a paper discharge device and an image forming apparatus including the paper discharge device, and FIG. 4 is a right side view of a paper discharge device and an image forming apparatus including the paper discharge device. As shown in FIGS. 3 and 4, the paper discharge device 100 includes a rotary motor 130 that rotates the holding unit 101, and a gear 131 that decelerates rotation of the rotary motor 130 and transmits the decelerated rotational force to the holding unit 10.

The gear 131 is provided with a slit and a rotary sensor that is an optical sensor for detecting the slit is mounted at the frame 132. The rotary motor 130 may employ a stepping motor. The rotating angle of the holding unit 101 and the position of the recording medium receiving inlet 106 are detected by the detection of the slit and the number of rotating steps of the rotary motor 130.

Figure 5:
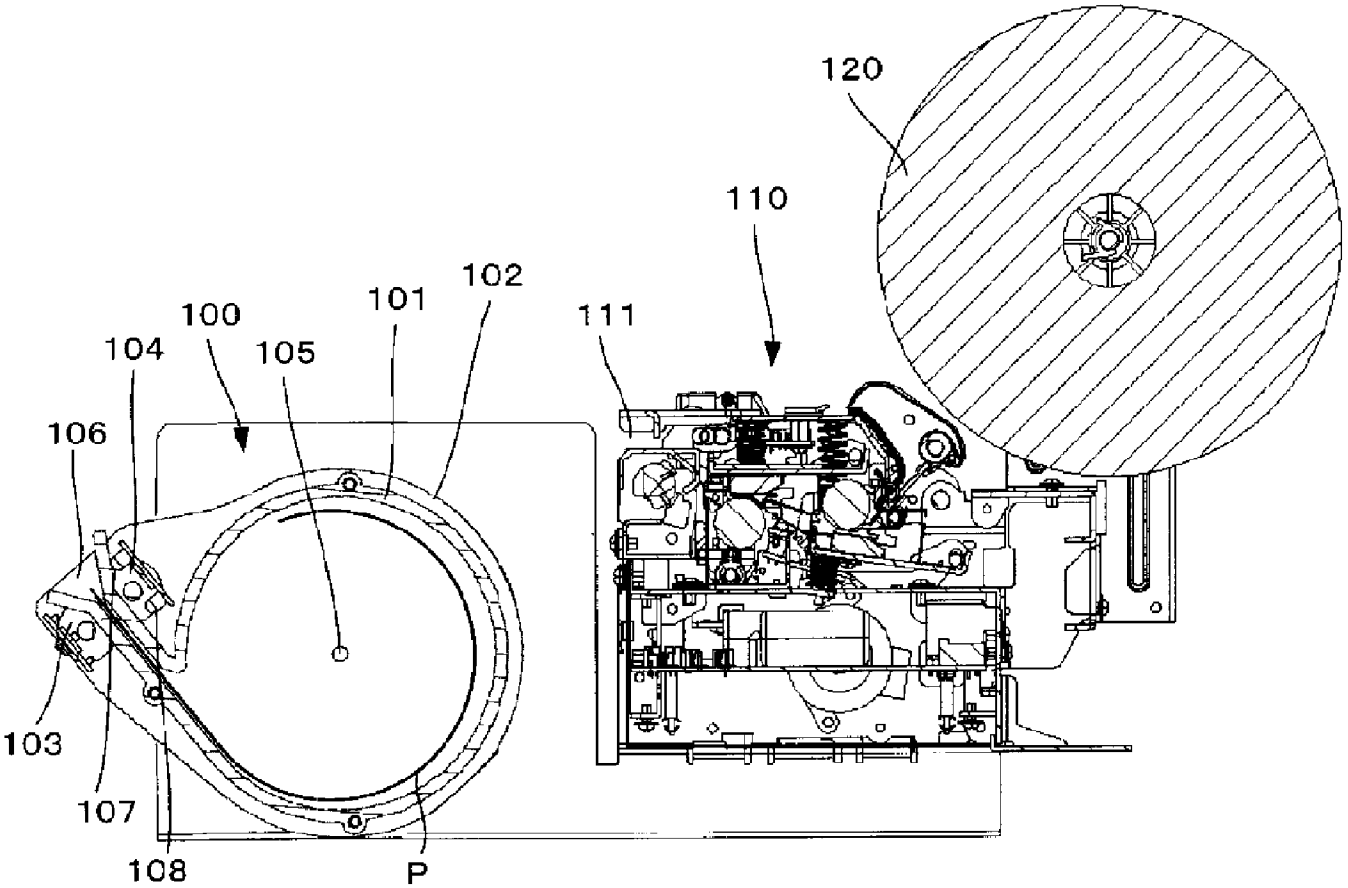
FIG. 5 is a side cross-sectional view of a paper discharge device according to an exemplary embodiment in a state where the discharge operation of a recording medium starts.

FIG. 5 is a side cross-sectional view of a paper discharge device in a state where the discharge operation of a recording medium starts. As shown in FIG. 5, in case the paper discharge device 100 discharges a recording medium, the holding unit 101 rotates along the turning shaft 105 by the rotary motor 130 until the recording medium receiving inlet 106 reaches a position where the recording medium is discharged.

In this state, the driven pinch roller 103 and the driving pinch roller 104 are rotated in directions opposite to each other so that the recording medium P held in a rolled state within the holding unit 101 is discharged to the outside. If the first sensor 107 does not enter an OFF state for a predetermined period of time, i.e., if a customer does not take out the recording medium P, the driven pinch roller 103 and the driving pinch roller 104 are rotated again to cause the recording medium P to be held within the holding unit 101.

Figure 6:
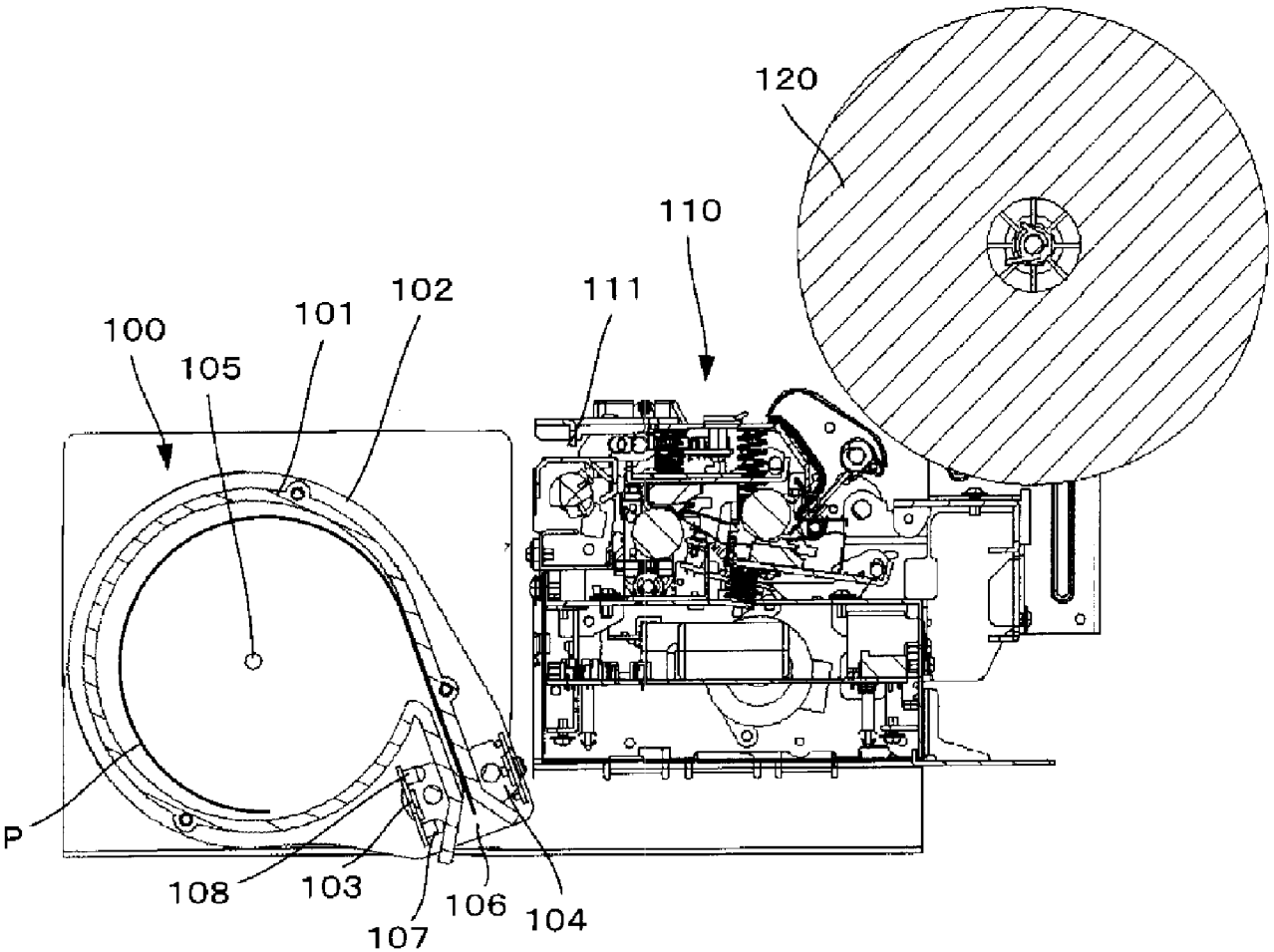
FIG. 6 is a side cross-sectional view of a paper discharge device according to an exemplary embodiment in a state where the collection operation of a recording medium is performed.

FIG. 6 is a side cross-sectional view of a paper discharge device in a state where the collection operation of a recording medium is performed. As shown in FIG. 6, in case the paper discharge device 100 collects the recording medium, the holding unit 101 rotates along the turning shaft 105 by the rotary motor 130 until the recording medium receiving inlet 106 reaches a position where the recording medium is collected.

In this state, the driven pinch roller 103 and the driving pinch roller 104 are rotated in directions opposite to each other so that the recording medium P held in a rolled state within the holding unit 101 is discharged out of the holding unit 101 and disposed in a collecting box.

Figure 7:
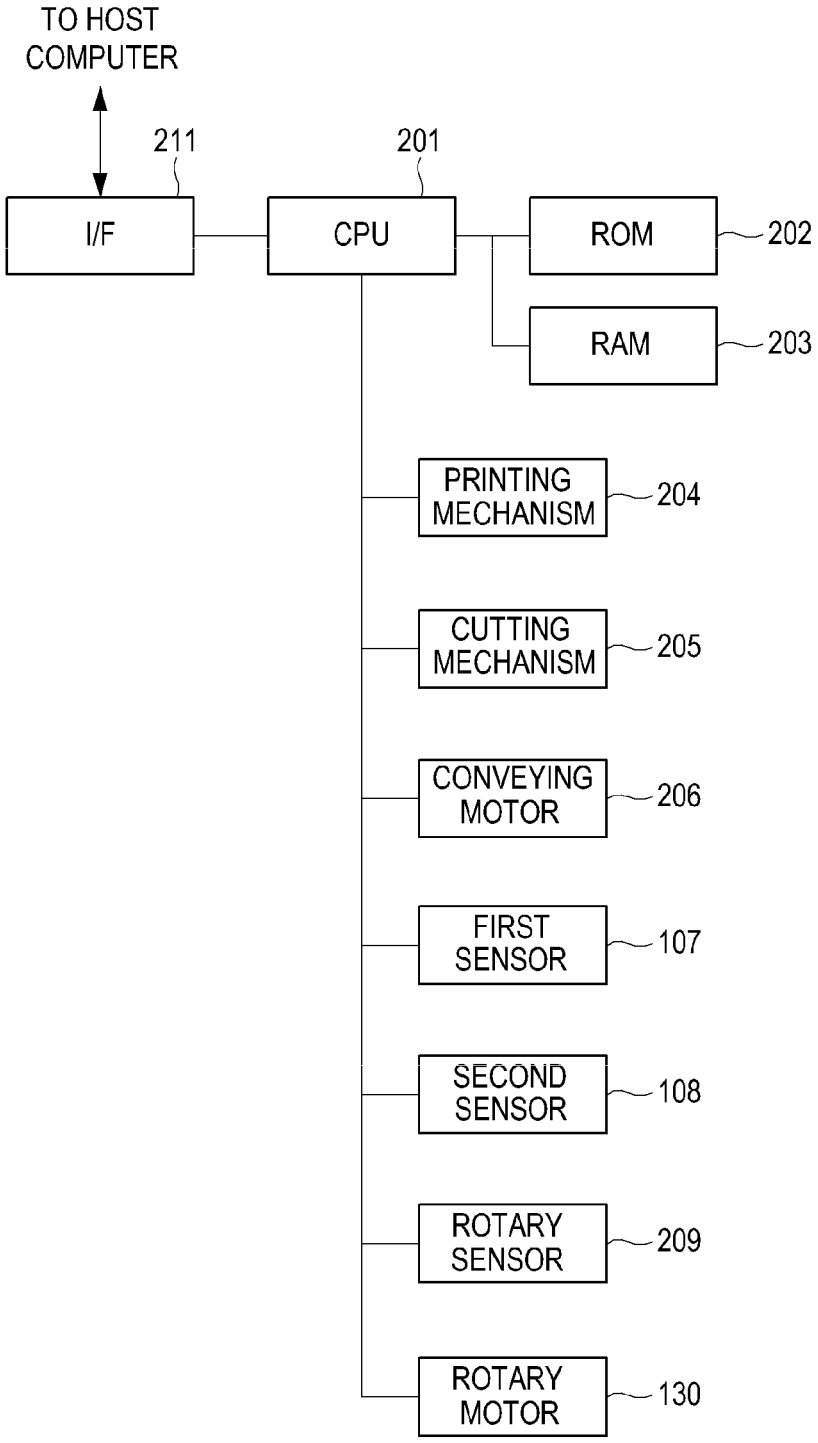
FIG. 7 is a block diagram showing the construction of hardware of a paper discharge device and an image forming apparatus including the paper discharge device according to an exemplary embodiment.

FIG. 7 is a block diagram showing a hardware configuration of a paper discharge device 100 and an image forming apparatus including the paper discharge device 100. As shown in FIG. 7, the image forming apparatus includes a CPU 201 as an arithmetic unit, ROM 202 and RAM 203 as storage units, a printing mechanism 204 that forms an image, a cutting mechanism 205 that cuts the recording medium P, a conveying motor 206 including a group of motors that convey the recording medium P, a first sensor 107, a second sensor 108, a rotary sensor 209, a rotary motor 130 that rotates the holding unit 101, an interface (I/F) 211 for connecting to a host computer. The printing mechanism 204 and the cutting mechanism 205 are included in the image forming unit 110.

The outputs of the first sensor 107 and the second sensor 108, and the rotary sensor 209 are inputted to the CPU 201 which in turn controls the operations of the printing mechanism 204, the cutting mechanism 205, the conveying motor 206 and the rotary motor 130.

Figure 8:
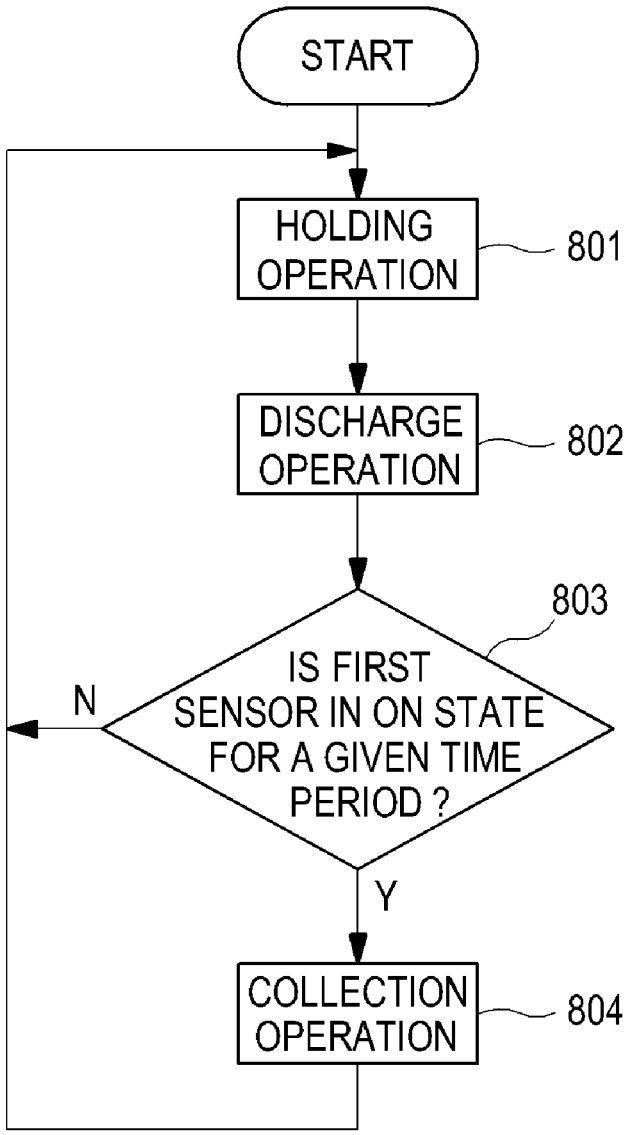
FIG. 8 is a flowchart showing the operation of a paper discharge device and an image forming apparatus including the paper discharge device according to an exemplary embodiment.

FIG. 8 is a flowchart showing the operation of a paper discharge device 100 and an image forming apparatus including the paper discharge device 100. As shown FIG. 8, the image forming apparatus performs a holding operation of the recording medium P having an image formed thereon in act 801, and performs a discharge operation of the recording medium P held in the paper discharge device 100 in act 802.

In act 803, the image forming apparatus determines whether the first sensor 107 is in an ON state for a predetermined period of time. If it is determined that the first sensor 107 is in an ON state for the predetermined period of time, the program proceeds to act 804. On the other hand, if it is determined in act 803 that the first sensor 107 enters an OFF state within the predetermined period of time, the program returns to act 801.

In act 804, the image forming apparatus performs a collecting operation of the recording medium P.

Figure 9:
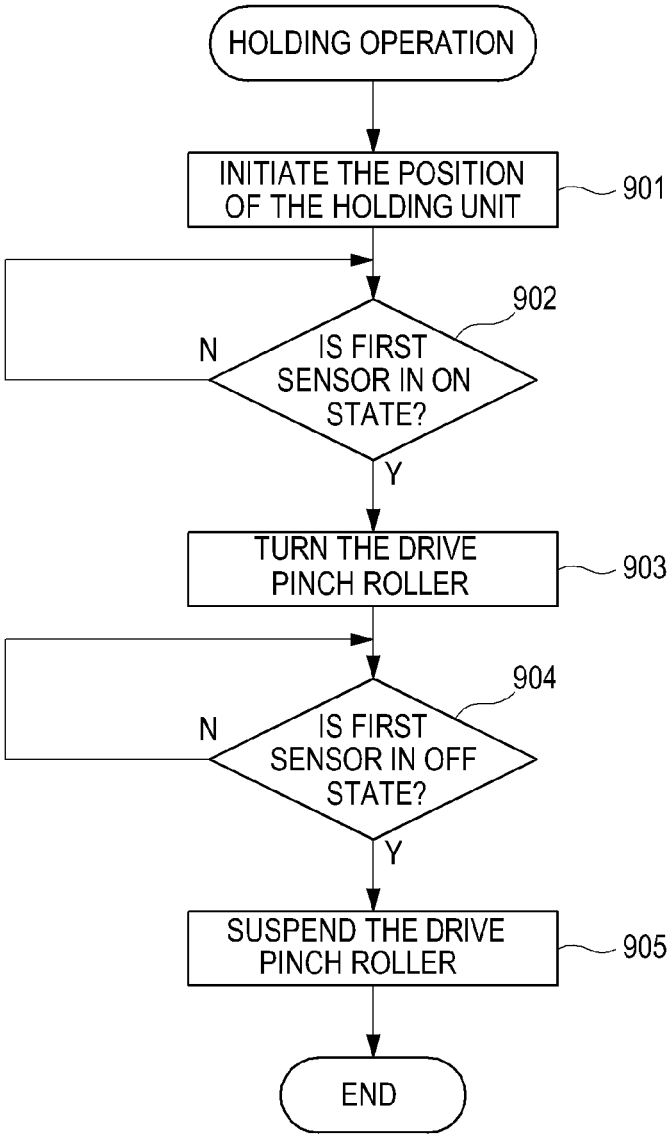
FIG. 9 is a flowchart showing the holding operation of a paper discharge device and an image forming apparatus including the paper discharge device according to an exemplary embodiment.

FIG. 9 is a flowchart showing the holding operation of a paper discharge device 100 and an image forming apparatus including the paper discharge device 100. As shown in FIG. 9, in act 910, the image forming apparatus initiates the position of the holding unit 101. The image forming apparatus allows the rotary motor 130 to rotate the holding unit 101 until the rotary sensor 209 detects the slit, i.e., the holding unit 101 reaches the start position of the holding operation.

In act 902, the image forming apparatus determines whether the first sensor 107 is in an ON state. If the first sensor 107 is in an ON state, the program proceeds to act 903. On the other hand, if the first sensor 107 is not in an ON state, the program returns to act 902.

In act 903, the image forming apparatus allows the driving pinch roller 104 to be rotated and allows the recording medium P to be conveyed into the holding unit 101 so that it is held in a rolled state. That is, the image forming apparatus allows the driving pinch roller 104 to be rotated when the first sensor 107 detects a front end of the recording medium, and allows the recording medium P to be conveyed into the holding unit 101.

In act 904, the image forming apparatus determines whether the first sensor 107 is in an OFF state. If first sensor 107 is in an OFF state, the program proceeds to act 905. On the other hand, if the first sensor 107 is not in an OFF state, the program returns to act 904.

In act 905, the image forming apparatus controls the driving pinch roller 104 to be suspended. That is, the image forming apparatus allows the conveyance of the recording medium P to be stopped when the first sensor 107 detects a rear end of the recording medium P. At this time, inserted into the nip portion between the driven pinch roller 103 and the driving pinch roller 104 is the recording medium P.

Figure 10:
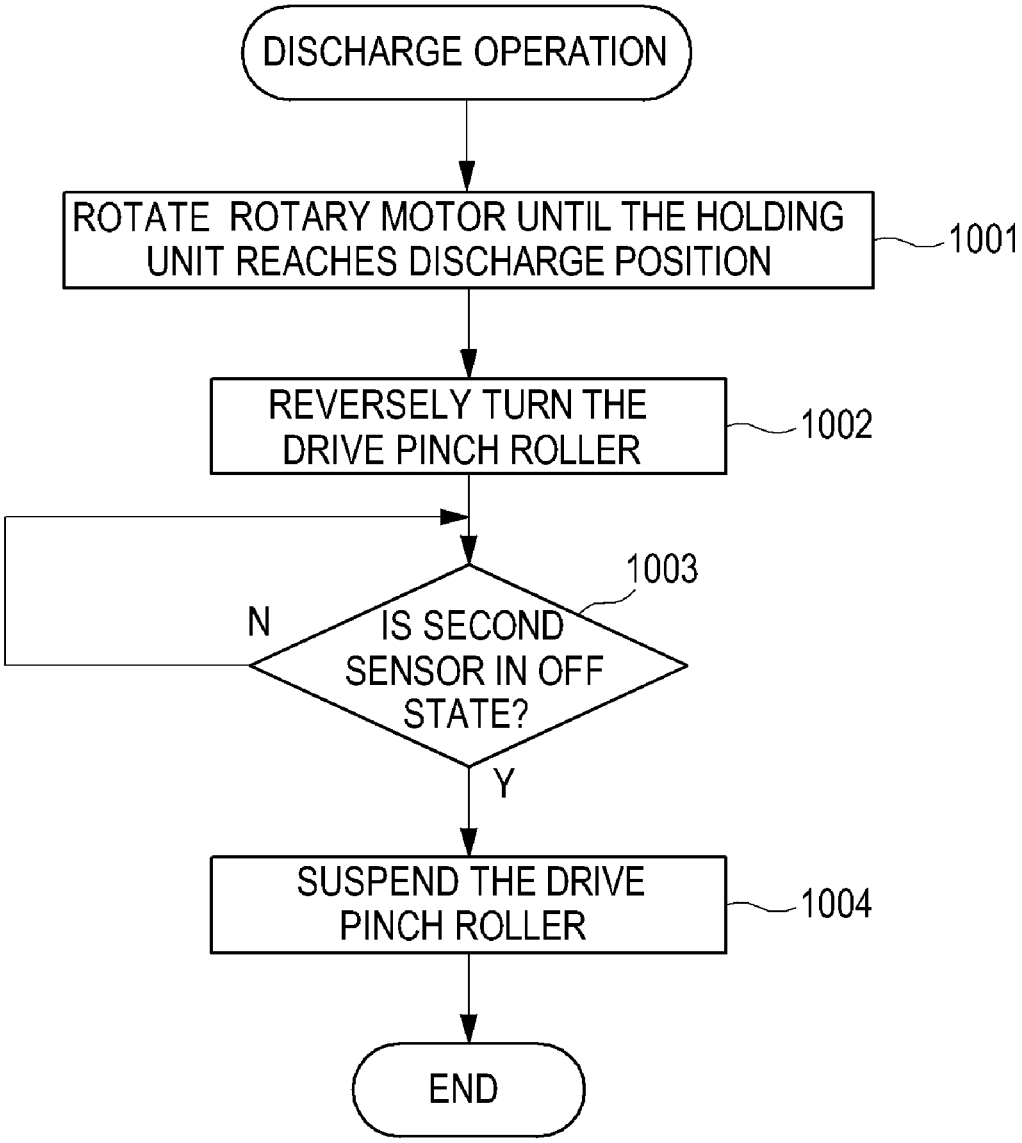
FIG. 10 is a flowchart showing the discharge operation of a paper discharge device and an image forming apparatus including the paper discharge device according to an exemplary embodiment.

FIG. 10 is a flowchart showing the discharge operation of a paper discharge device 100 and an image forming apparatus including the paper discharge device 100. As shown in FIG. 10, in act 1001, the image forming apparatus controls the rotary motor 130 to be rotated by a predetermined number of rotating steps so that the holding unit 101 reaches the discharge position of the recording medium.

In act 1002, the image forming apparatus controls the drive driving pinch roller 104 to be rotated in a direction opposite to the rotation direction thereof for holding the recording medium P, so that the recording medium P starts to be discharged to the outside.

In act 1003, the image forming apparatus determines whether the second sensor 108 is in an OFF state. If the second sensor 108 is in an OFF state, the program proceeds to act 1004. On the other hand, if the second sensor 108 is not in an OFF state, the program returns to act1003 .

In act 1004, the image forming apparatus controls the driving pinch roller 104 to be suspended. That is, the image forming apparatus allows the discharge of the recording medium P to be stopped when the second sensor 108 detects a rear end of the recording medium P. At this time, inserted into the nip portion between the driven pinch roller 103 and the driving pinch roller 104 is the recording medium P.

Figure 11:
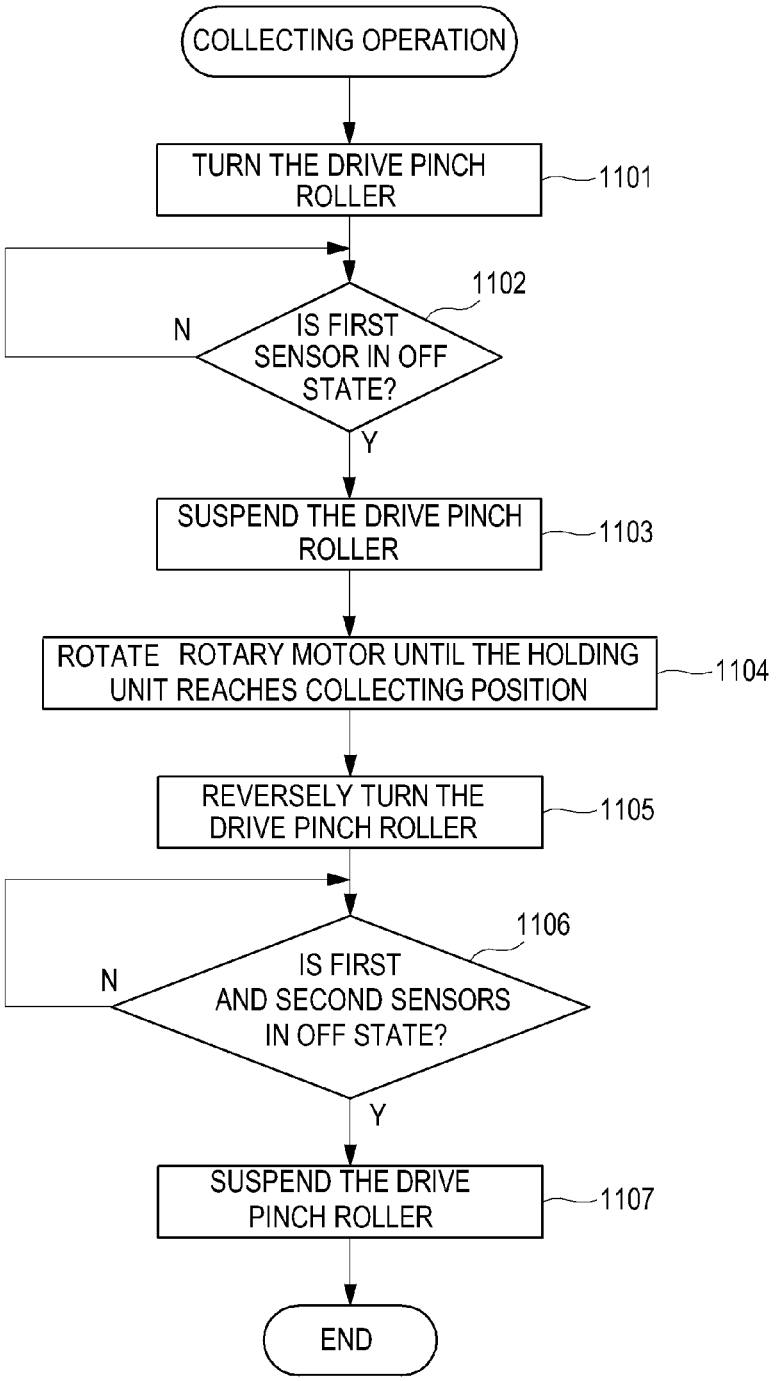
FIG. 11 is a flowchart showing the collection operation of a paper discharge device and an image forming apparatus including the paper discharge device according to an exemplary embodiment.

FIG. 11 is a flowchart showing the collection operation of a paper discharge device 100 and an image forming apparatus including the paper discharge device 100. As shown in FIG. 11, in act 1101, the CPU 210 of the image forming apparatus controls the driving pinch roller 104 to be rotated to cause the recording medium P to be again conveyed into the holding unit 101 so that the recording medium P is held in a rolled state within the holding unit 101.

In act 1102, the image forming apparatus determines whether the first sensor 107 is in an OFF state. If the first sensor 107 is in an OFF state, the program proceeds to act 1103. On the other hand, if the first sensor 107 is not in an OFF state, the program returns to act 1102.

In act 1103, the image forming apparatus controls the driving pinch roller 104 to be suspended. That is, the image forming apparatus allows the conveyance of the recording medium P to be stopped when the first sensor 107 detects a rear end of the recording medium P. At this time, inserted into the nip portion between the driven pinch roller 103 and the driving pinch roller 104 is the recording medium P.

In act 1104, the image forming apparatus controls the rotary motor 130 to be rotated by a predetermined number of rotating steps so that the holding unit 101 reaches the collecting position.

In act 1105, the image forming apparatus controls the driving pinch roller 104 to be rotated in a direction opposite to the rotating direction thereof for holding the recording medium P, and then the recording medium P starts to be discharged to the outside.

In act 1106, the image forming apparatus determines whether the first sensor 107 and the second sensor 108 are in an OFF state. If the first sensor 107 and the second sensor 108 are in an OFF state, the program proceeds to act 1107. On the other hand, if any of the first sensor 107 and the second sensor 108 is not in an OFF state, the program returns to act 1106.

In act 1107, the image forming apparatus controls the driving pinch roller 104 to be suspended. That is, the image forming apparatus suspends the driving pinch roller 104 when the first sensor 107 and the second sensor 108 detect completion of the discharge of the recording medium P.

In one embodiment, the second sensor 108 may be omitted in the hardware configuration. In such case, the image forming apparatus may be configured such that the driving pinch roller 104 is suspended after a lapse of a predetermined period of time from when the first sensor 107 enters an OFF state.

As described above, the paper discharge device 100 and the image forming apparatus including the paper discharge device 100 according to this embodiment include the holding unit 101 which is rotatably mounted and is configured to hold the recording medium P received from the image forming unit 110 in a rolled state within the holding unit 101. The paper discharge device 100 performs the holding operation before the discharge operation. When the recording medium P is discharged, the paper discharge device 100 allows the holding unit 101 to be rotated to reach the discharge position so that the recording medium P is discharged. When the recording medium P is collected, the paper discharge device 100 allows the recording medium P to be again held within the holding unit 101, and then allows the holding unit 101 to be rotated to reach the collecting position.

Therefore, the paper discharge device in some embodiments allows for a recording medium to be held within the paper discharge device until the completion of the printing of the recording medium, and may also in some embodiments allow a recording medium that is not taken out by a customer to be collected by the paper discharge device. In addition, the size of the device in some embodiments can be reduced and a degree of freedom of a recording medium discharge direction can increase.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus and can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS(Operating System) or the like in the apparatus.

While certain embodiments have been described, these embodiments have been presented by way of example only, and are not intended to limit the scope of the inventions. Indeed, the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper discharge device comprising:

a holding unit mounted rotatably to a frame by means of a turning shaft, the holding unit comprising:

a recording medium receiving inlet configured to receive a recording medium;

a recording medium feeding path through which the recording medium received from the recording medium receiving inlet is conveyed; and a cylindrical housing configured to hold the recording medium received from the recording medium inlet, the turning shaft being positioned along a rotational axis through the center of the cylindrical housing;

a driven pinch roller and a driving pinch roller disposed at the recording medium receiving inlet; and a first sensor disposed at the recording medium receiving inlet and a second sensor disposed at the recording medium receiving inlet with the driving pinch roller interposed between the first sensor and the second sensor, wherein the holding unit rotates about the turning shaft to reach a holding position where the recording medium is received from an image forming unit, and the driven pinch roller and the driving pinch roller are rotated until the first sensor detects a first rear end of the recording medium to cause the recording medium to be held within the cylindrical housing, wherein the holding unit rotates about the turning shaft to reach a discharge position where the recording medium is discharged, and the driven pinch roller and the driving pinch roller are rotated until the second sensor detects a second rear end of the recording medium to cause the recording medium to be discharged, wherein if the recording medium is not taken at the discharge position within a predetermined period of time, the driven pinch roller and the driving pinch roller are rotated to cause the recording medium to be held within the cylindrical housing, the holding unit rotates to reach a collecting position where the recording medium is collected in a collecting box, and the driven pinch roller and the driving pinch roller are rotated to cause the recording medium to be discharged into the collecting box.

2. The paper discharge device of claim 1, wherein the recording medium has an image formed thereon.

3. The paper discharge device of claim 1, wherein when the recording medium is held within the cylindrical housing, the recording medium is held in a rolled state.

4. The paper discharge device of claim 1, wherein the first sensor is disposed at a side of the recording medium inlet.

5. The paper discharge device of claim 1, wherein the second sensor is disposed at a side of the cylindrical housing.

6. The paper discharge device of claim 1, wherein when the holding unit to reach the discharge position where the recording medium is discharged, the driven pinch roller and the driving pinch roller are rotated in a reverse direction to discharge the recording medium.

7. The paper discharge device of claim 1, wherein when the holding unit rotates to reach the collecting position where the recording medium is collected, the driven pinch roller and the driving pinch roller are rotated in a reverse direction to cause the recording medium to be discharged.

8. The paper discharge device of claim 1, wherein the cylindrical housing is formed in a cylindrical shape, and the recording medium feeding path is formed along a tangential line of the cylindrical housing.

9. An image forming apparatus comprising:

a paper discharge device which comprises:

a holding unit mounted rotatably to a frame by means of a turning shaft, the holding unit comprising:

a recording medium receiving inlet configured to receive a recording medium having an image formed thereon;

a recording medium feeding path through which the received recording medium is conveyed; and a cylindrical housing configured to hold the conveyed recording medium in a rolled state within the cylindrical housing, the turning shaft being positioned along a rotational axis through the center of the cylindrical housing;

a driven pinch roller and a driving pinch roller mounted at the recording medium receiving inlet; and a first sensor disposed at a side of the recording medium receiving inlet and a second sensor disposed at a side of the cylindrical housing with the driving pinch roller interposed between the first sensor and the second sensor; and an image forming unit comprising a conveying mechanism configured to convey a recording medium and a printing mechanism configured to perform a printing operation on the recording medium conveyed by the conveying mechanism, wherein the holding unit rotates about the turning shaft to reach a holding position where the recording medium having an image formed thereon is received from the image forming unit, and the driven pinch roller and the driving pinch roller are rotated until the first sensor detects a first rear end of a paper to cause the recording medium to be held in a rolled state within the cylindrical housing, wherein the holding unit is rotated about the turning shaft to a discharge position where the recording medium is discharged, and the driven pinch roller and the driving pinch roller are rotated reversely until the second sensor detects a second rear end of the paper to cause the recording medium to be discharged, wherein if the recording medium is not taken at the discharge position within a predetermined period of time, the driven pinch roller and the driving pinch roller are rotated to cause the recording medium to be held again in a rolled state within the cylindrical housing, the holding unit rotates to reach a collecting position where the recording medium is collected in a collecting box, and the driven pinch roller and the driving pinch roller are rotated in a reverse direction to cause the recording medium to be discharged into the collecting box.

10. The paper discharge device of claim 9, wherein the cylindrical housing is formed in a cylindrical shape, and the recording medium feeding path is formed along a tangential line of the cylindrical housing.

11. A method of discharging paper comprising:

receiving a recording medium at a recording medium receiving inlet of a holding unit mounted rotatably to a frame by means of a turning shaft;

detecting the recording medium with a first sensor located at the recording medium inlet;

moving the recording medium along a recording medium feeding path with a driven pinch roller and a driving pinch roller;

rotating the driven pinch roller and the driving pinch roller until the first sensor detects a first rear end of the recording medium to cause the recording medium to be held within a cylindrical housing of the holding unit, the turning shaft being positioned along a rotational axis through the center of the cylindrical housing;

rotating the holding unit about the turning shaft to reach a discharge position, where the recording medium is discharged;

rotating the driven pinch roller and the driving pinch roller until a second sensor located at the recording medium inlet detects a second rear end of the recording medium to cause the recording medium to be discharged; and if the recording medium is not taken at the discharge position within a predetermined period of time, rotating the driven pinch roller and the driving pinch roller to cause the recording medium to be held within the cylindrical housing, rotating the holding unit to a collecting position where the recording medium is collected in a collecting box, and rotating the driven pinch roller and the driving pinch roller to cause the recording medium to be discharged into the collecting box.

12. The method of claim 11, wherein when the recording medium is held within the cylindrical housing, the recording medium is held in a rolled state.

13. The method of claim 11, wherein when the holding unit reaches a discharge position where the recording medium is to be discharged, the driven pinch roller and the driving pinch roller are rotated in a reverse direction to discharge the recording medium.

* * * * *